US005379860A

United States Patent [19]

Tang

[11] Patent Number: 5,379,860

[45] Date of Patent: Jan. 10, 1995

[54] CARRIER FOR CONSTRUCTION OF BUILDINGS

[76] Inventor: I-Shya Tang, No. 20, Wu Chuan W. Road, Taichung, Taiwan, Prov. of China

[21] Appl. No.: 101,543

[22] Filed: Aug. 2, 1993

[51] Int. Cl.[6] ..... E04G 21/00

[52] U.S. Cl. ..... 182/145; 182/130

[58] Field of Search ..... 182/145, 146, 141, 130, 182/131, 132

[56] References Cited

U.S. PATENT DOCUMENTS

| | | | |
|---|---|---|---|
| 1,068,442 | 7/1913 | Mills | 182/146 X |
| 1,251,066 | 12/1917 | McClanahan | 182/145 X |
| 3,224,065 | 12/1965 | Cheslein | 182/146 X |

FOREIGN PATENT DOCUMENTS

| | | | |
|---|---|---|---|
| 133128 | 5/1929 | Switzerland | 182/145 |

*Primary Examiner*—Alvin C. Chin-Shue

*Attorney, Agent, or Firm*—Poms, Smith, Lande & Rose

[57] ABSTRACT

A carrier having (a) a frame having a middle portion transversely formed between two lateral portions attachable to and detachable from a layer of wall formed between two shutters, the lateral portions having a length more than twice as great as the height of the shutters and (b) a rectilinear elevator operatively linked to the middle portion of the frame so that the frame is slidable upwards and downwards by means of the elevator. The elevator moves itself upwards relative to the frame when the lateral portions of the frame are attached to a first layer of wall so that the frame carries workers who install shutters between which concrete is grouted for a second layer of wall. The elevator moves the frame upwards relative thereto when the second layer of wall solidifies so that the lateral portions of the frame can be detached from the first layer of wall and attached to the second layer of wall and that the elevator can move itself upwards relative to the frame. Thus, it is possible to grout concrete between shutters for higher layers of wall by repeating the above-defined steps.

7 Claims, 10 Drawing Sheets

CARRIER FOR CONSTRUCTION OF BUILDINGS

BACKGROUND OF INVENTION

1. Field of Invention

This invention relates to a carrier for carrying workers, tools, materials and etc. required for construction of high buildings.

2. Related Prior Art

Conventional construction of high buildings involves construction of scaffold corresponding to the high buildings to be built. Workers who carry tools, materials and etc. deal with various layers of high buildings by means of scaffold. Scaffold is dismantled when high buildings are finished. Considerable time and labor time are required to erect and dismantle scaffold.

SUMMARY OF INVENTION

Therefore, the primary object of this invention is to replace scaffold with a carrier for construction of high buildings. The carrier has (a) a frame having a middle portion transversely formed between two lateral portions attachable to and detachable from a layer of wall formed between two shutters, the lateral portions having a length more than twice as great as the height of the shutters and (b) a rectilinear elevator operatively linked to the middle portion of the frame so that the frame is slidable upwards and downwards by means of the elevator. The elevator moves itself upwards relative to the frame when the lateral portions of the frame are attached to a first layer of wall so that the frame carries workers who install shutters between which concrete is grouted for a second layer of wall. The elevator moves the frame upwards relative thereto when the second layer of wall solidifies so that the lateral portions of the frame can be detached from the first layer of wall and attached to the second layer of wall and that the elevator can move itself upwards relative to the frame. Thus, it is possible to grout concrete between shutters for higher layers of wall by repeating the above-defined steps.

For a better understanding of the present invention and objects thereof, a study of the detailed description of the embodiments described hereinafter should be made in relation to the accompanying drawings.

DETAILED DESCRIPTION OF PREFERRED EMBODIMENT

Referring to FIGS. 1 through 7 of the drawings, a carrier has a number of elevators 40 slidably joined together with a frame 50, and this will be described in detail in a later stage.

Figure 1:
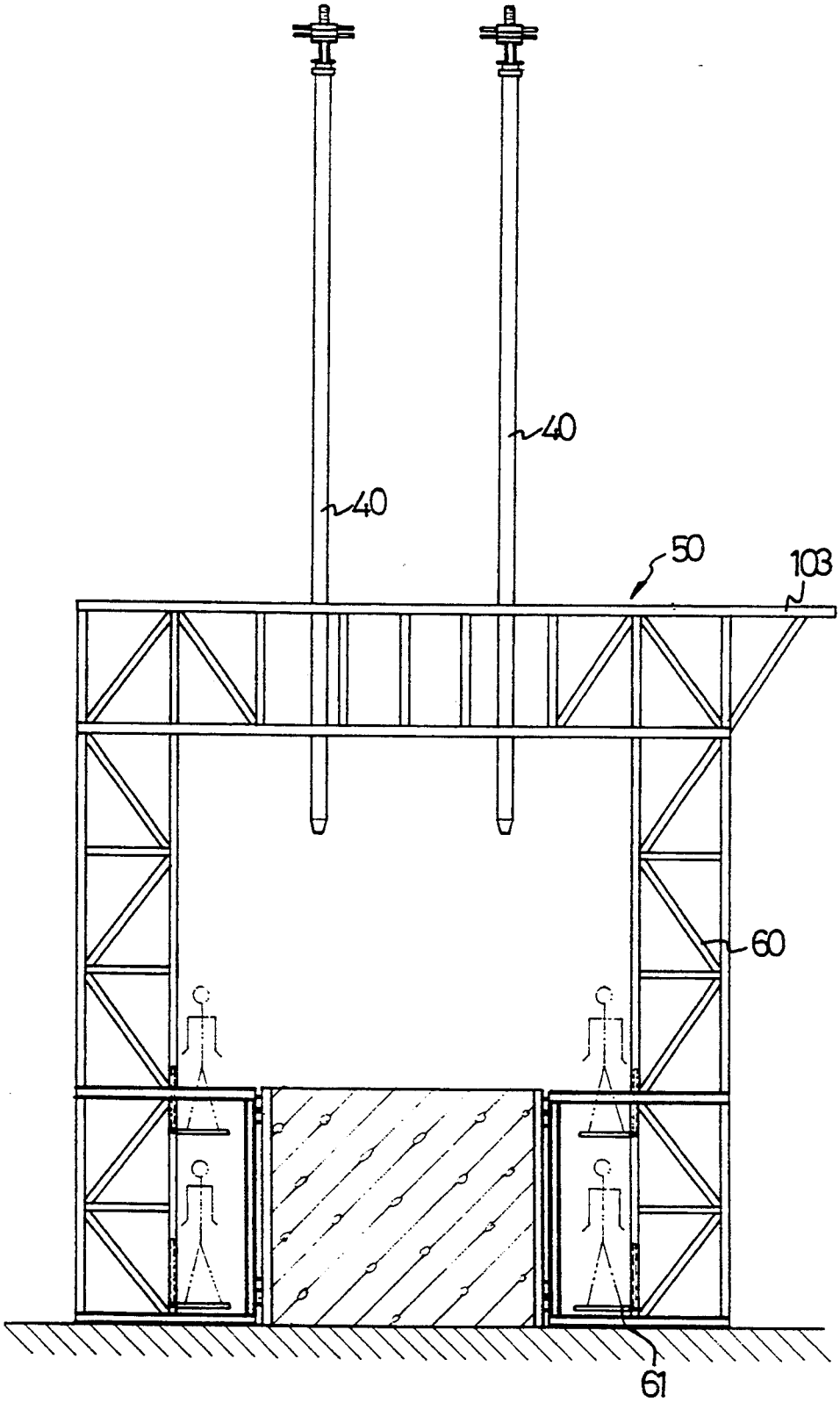
FIGS. 1 through 7 are simplified front views of a carrier in accordance with the preferred embodiment of the present invention, showing the carrier in various positions.

Referring to FIG. 1 of the drawings, the elevators 40 each have an upper tip and a lower tip. The frame 50 has a horizontal portion formed between two vertically downwardly extending portions 60 each having a tip. Two minor elevators 61 are slidably mounted on the vertical portions 60. Two shutters 30 are installed on the ground conventionally, separate from each other, so that concrete can be grouted between the shutters 30.

Figure 2:
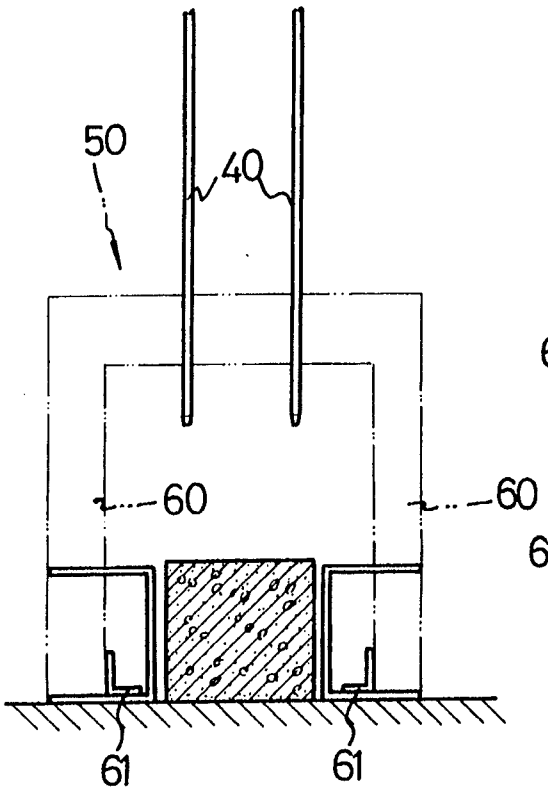

Referring to FIG. 2 of the drawings, concrete is grouted between the shutters 30. Later, the concrete grouted between the shutters 30 will solidify so as to form a first layer of wall or a first layer of column if steel rods or girders are disposed therein. Then, the shutters 30 are removed from the first layer of wall.

The elevators 40 are in a high position relative to the frame 50. That is, the lower ends of the elevators 40 are higher than the level on which the shutters 30 are retained. Thus, the elevators 40 will not be submerged in the concrete grouted between the shutters 30, i.e., the elevators 40 will not be stuck in the first layer of wall. The tips of the frame 50 are on the ground. The minor elevators 61 are also retained in a low position relative to the frame 50, i.e., the minor elevators 61 are retained on the ground for carrying workers, tools, materials and etc.

Figure 3:
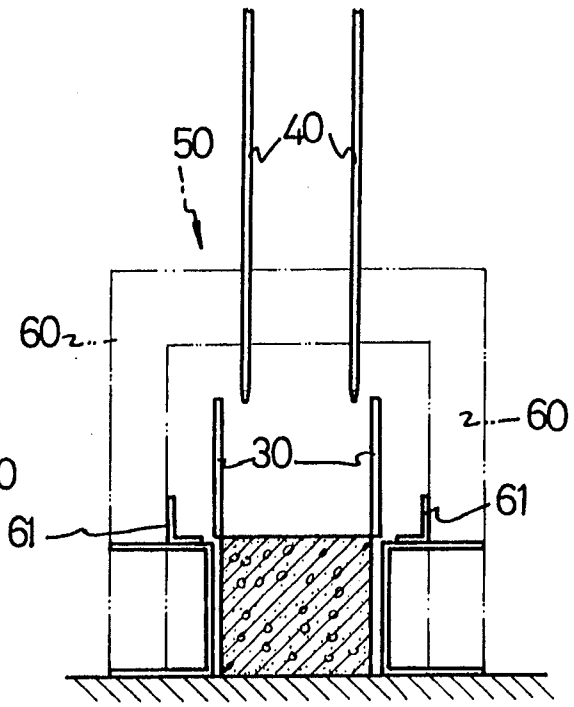

Referring to FIG. 3 of the drawings, the minor elevators 60 are moved to a high position relative to the frame 50. Thus, the workers, tools and shutters 30 can be moved to a level higher than the first layer of wall. The shutters 30 are installed above the first layer of wall conventionally by means of the workers carried by means of the minor elevators 61.

Figure 4:
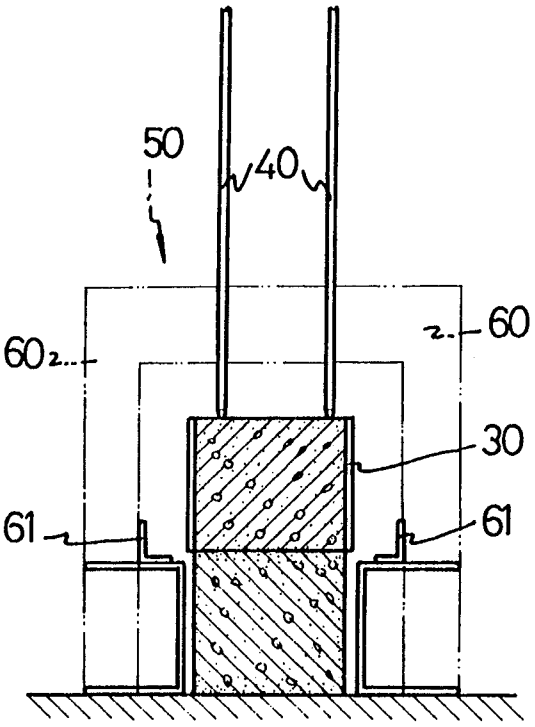

Referring to FIG. 4 of the drawings, concrete is grouted between the shutters 30. The concrete grouted between the shutters 30 will solidify so as to form a second layer of wall in a later stage. Then, the shutters 30 are removed from the second layer of wall.

The elevators 40 are in the high position relative to the frame 50. That is, the lower ends of the elevators 40 are higher than the level on which the shutters 30 are retained. Thus, the elevators 40 will not be submerged in the concrete grouted between the shutters 30, i.e., the elevators 40 will not be stuck in the second layer of wall.

Figure 5:
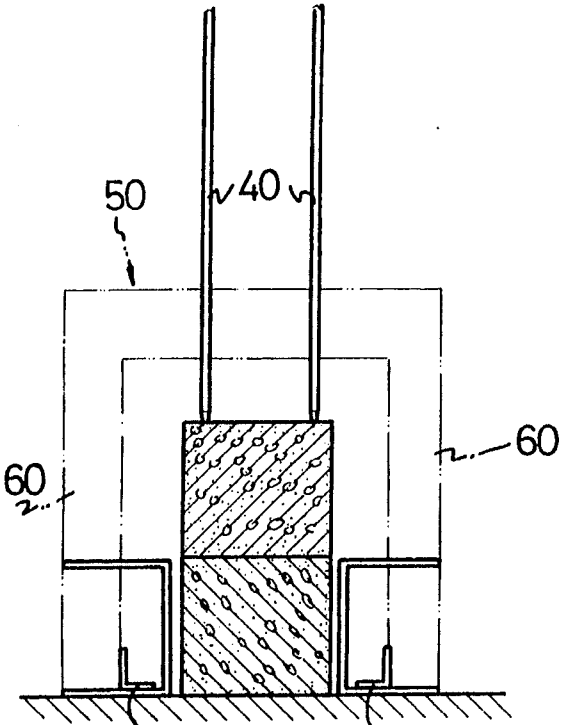

Referring to FIG. 5 of the drawings, the minor elevators 61 are moved to the low position relative to the frame 50. The lower ends of the elevators 40 contact the second layer of wall, i.e., the elevators 40 stand on the second layer of wall.

Figure 6:
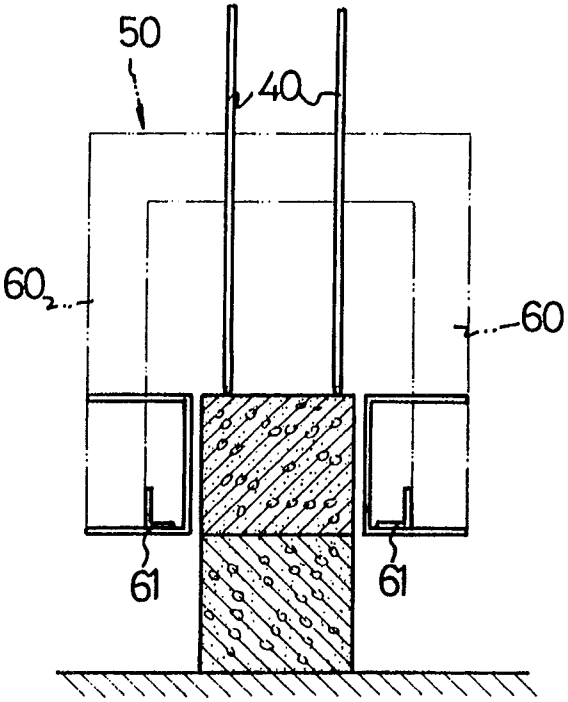

Referring to FIG. 6 of the drawings, the elevators 40 move the frame 50 to a high position relative thereto.

The vertical portions 60 are attached to the second layer of wall in a way to be described later.

Figure 7:
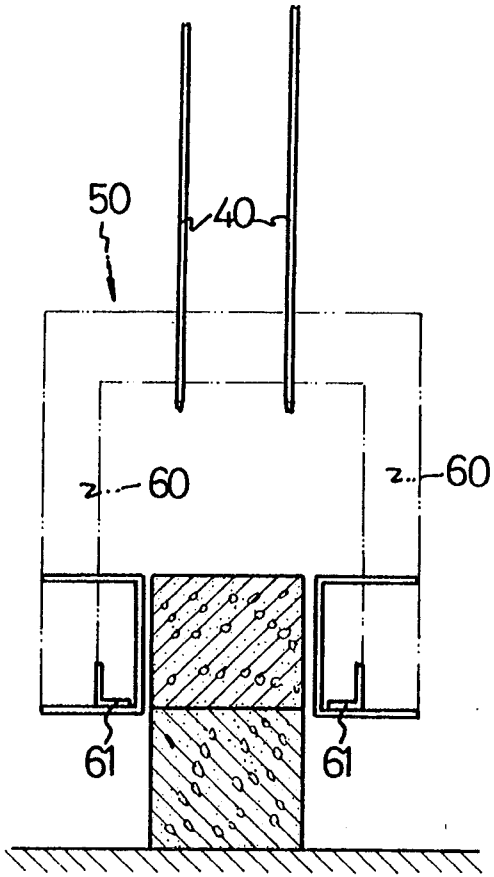

Referring to FIG. 7 of the drawings, the elevators 40 move themselves to the high position relative to the frame 50. FIGS. 2 and 7 show two similar positions, except that the vertical portions 60 are installed on the ground shown in FIG. 2, while the vertical portions 60 are attached to the second layer of wall shown in FIG. 7. Obviously, the steps shown in FIGS. 3 through 7 can be repeated in order to make higher layers of wall.

Figure 8:
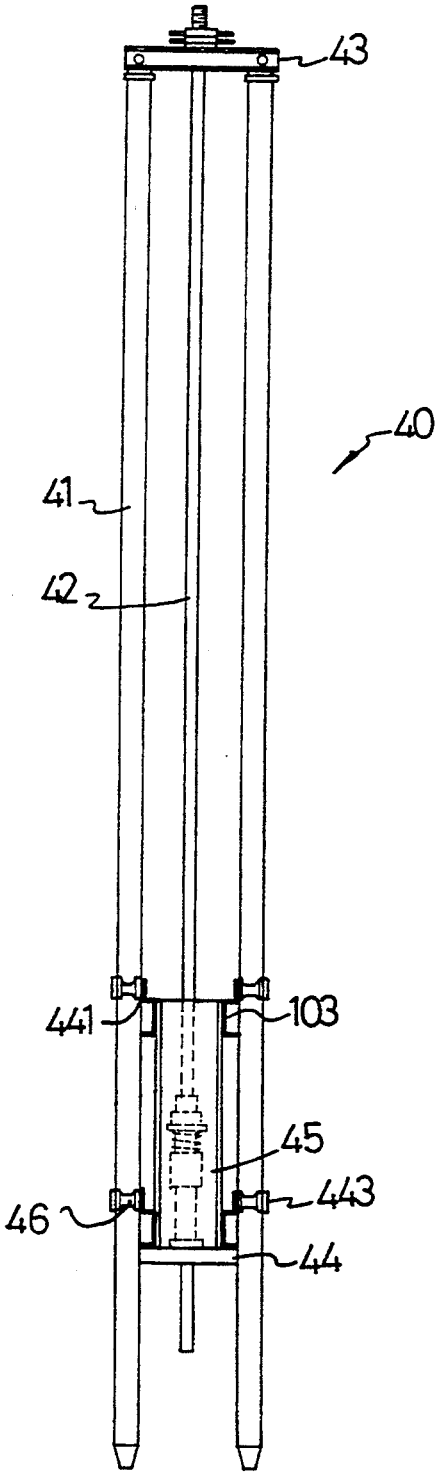
FIG. 8 is a left view of an elevator in accordance with the preferred embodiment of the present invention.

Referring to FIG. 8 of the drawings, each elevator 40 has two rods 41 and a ladder 42 mounted between the rods 41. A climber means 45 is slidably mounted on the ladder 42. A plate 44 is attached to the climber means 45. The frame 50 is attached to the plate 44.

Figure 9:
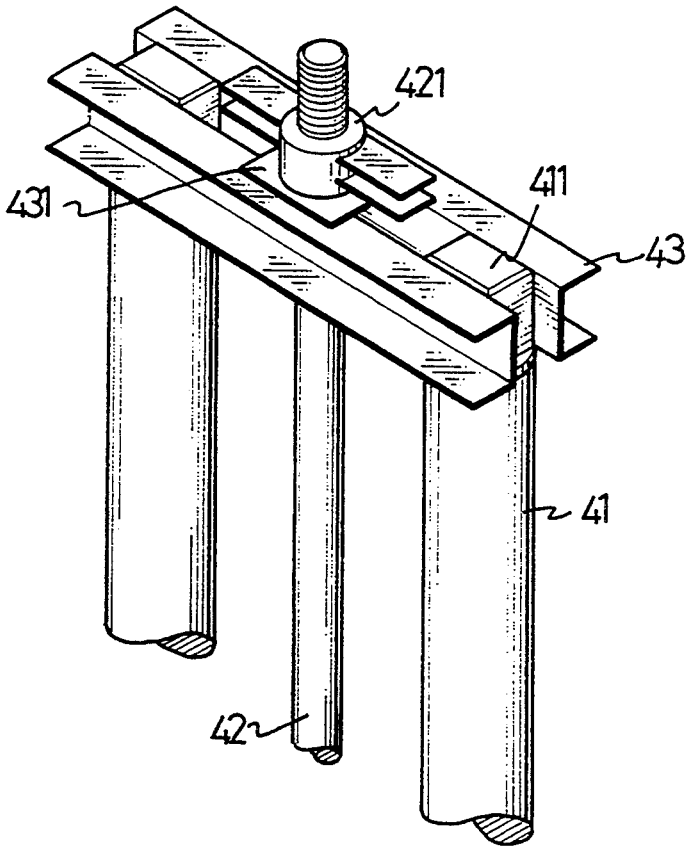
FIG. 9 is a perspective view of an upper portion of the elevator in accordance with the preferred embodiment of the present invention.

Referring to FIG. 9 of the drawings, each rod 41 has an upper end 411. The upper end 411 has a rectangular form as shown in a top view. Thus, the upper ends 411 can be sandwiched between two elements 43 and attached to the same by means of welding. A plate 431 is attached to the elements 43 by means of welding. The plate 431 defines a hole through which an upper end of the ladder 42 is inserted. A threading is formed on the upper end of the ladder 42. A threading is formed in a nut 421. The upper end of the ladder 42 is secured in the nut 421 so that the ladder 42 is connected to the rods 41.

Figure 10:
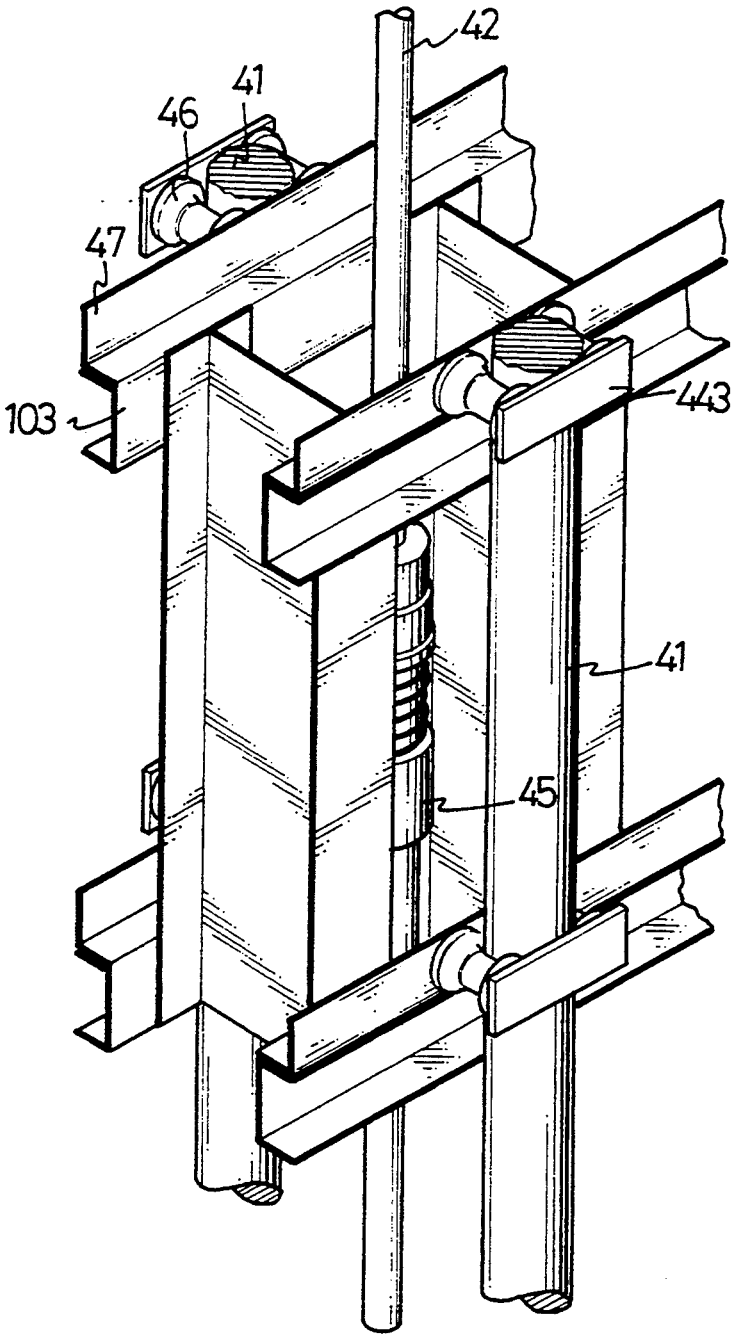
FIG. 10 is a perspective view of a lower portion of the elevator in accordance with the preferred embodiment of this invention.

Referring to FIG. 10 of the drawings, the climber means 45 is a formed as a sleeve through which the ladder 42 is inserted. The climber means 45 is capable of moving upwards and downwards on the ladder 42. However, the climber means 45 will not be described in detail as it is well known. The plate 44 is attached to the climber means 45 by means of welding. The frame 50 has at least four rails 103. Two of the rails 103 are attached to the plate 44 by means of welding so that the frame 50 moves together with the climber means 45.

As shown in a left view, each rail 103 is like a "U" rotated 90°. Four elements 47 are attached to the rails 103 by means of welding. As shown in a left view, each element 47 is like an "L", i.e., it has a vertical portion and a horizontal portion. Four pairs of rollers 46 are attached on the vertical portions of the four elements 47. Each rod 41 is inserted between two corresponding pairs of rollers 46. The engagement of the rods 41 with the rollers 46 reduces vibration when the elevators 40 move the frame 50 relative thereto.

How the frame 50 is attached to the wall will be described in detail with reference to FIGS. 11 through 14 of the drawings.

Figure 11:
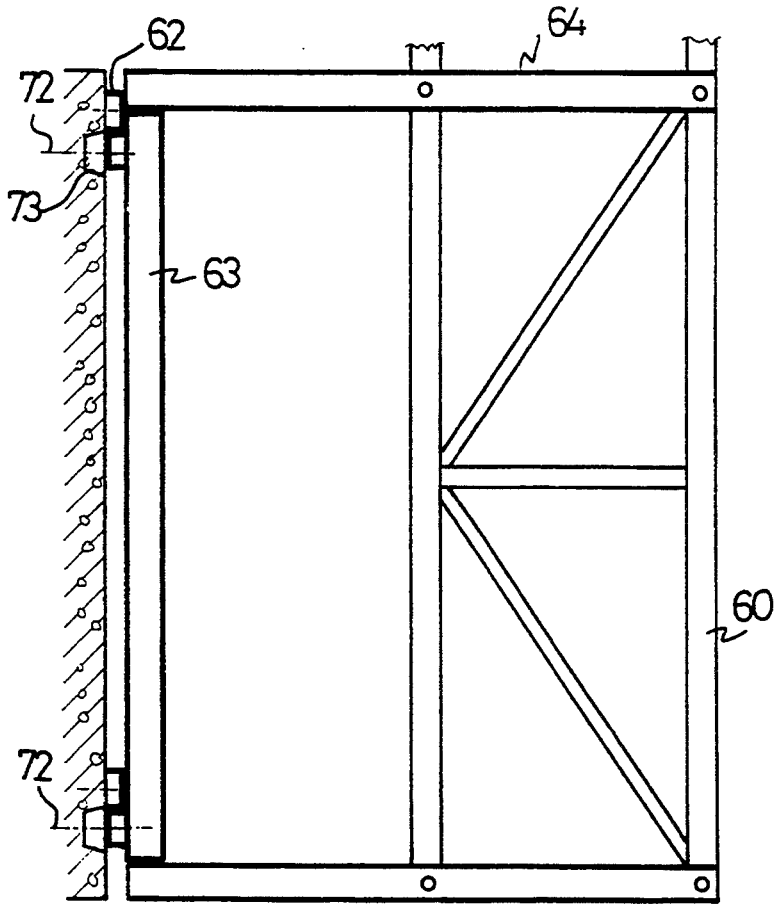
FIG. 11 is a side view of the lower portion of the elevator carrying a casing in accordance with the preferred embodiment of this invention.
Figure 12:
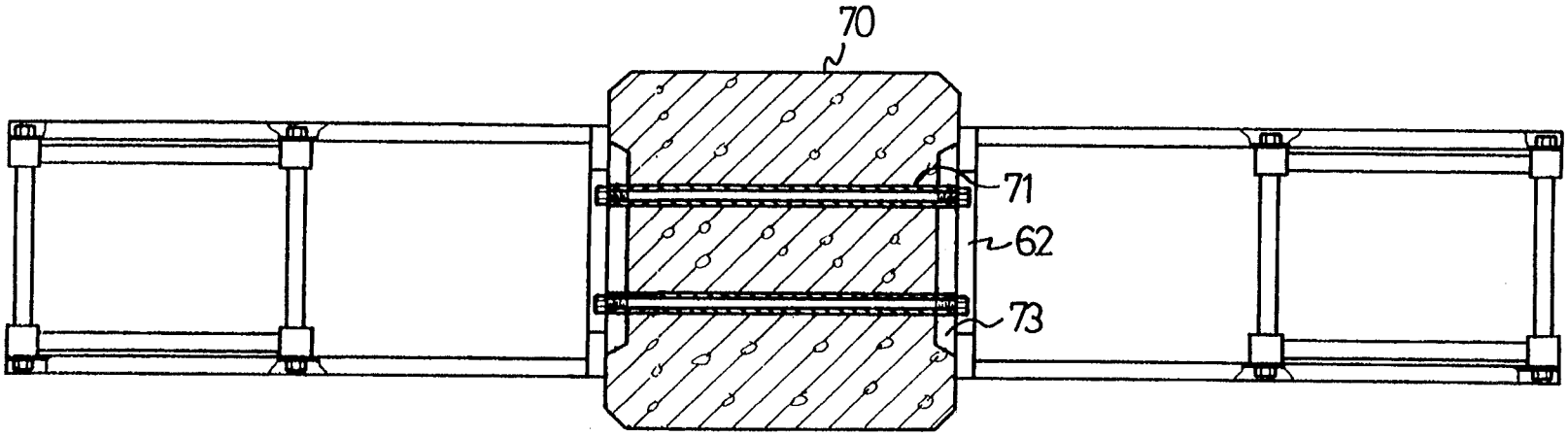
FIG. 12 is a partial view of the elevator according to the preferred embodiment of the present invention.

Referring to FIGS. 11 and 12 of the drawings, four tubes 71 are buried in concrete grouted between the shutters 30. Four bolts 72 are inserted through the tubes 71. Each bolt 72 has two threaded ends exposed to the exterior of the wall.

The vertical portions 60 are each connected with two columns 63 by means of four beams 64. The columns 63 each define a number of holes. Two mounts 62 each define two holes and two slots. The mounts 62 are each horizontally attached to the columns 63 by means of two threaded bolts inserted through the holes formed therein and two holes formed in the columns 63.

Figure 13:
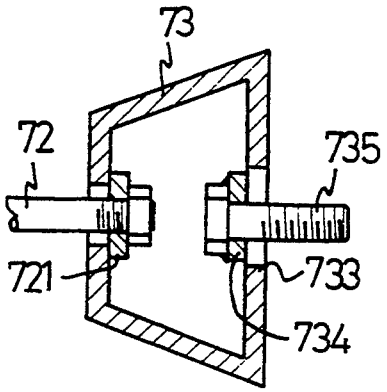
FIG. 13 is a horizontal cross-sectional view of a joint for linking the frame to the building, in accordance with the preferred embodiment of this invention.
Figure 14:
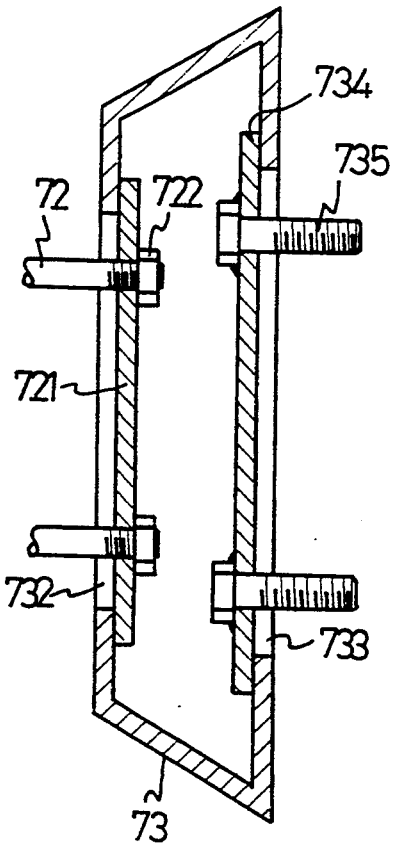
FIG. 14 is a vertical cross-sectional view of the joint for linking the frame to the building, in accordance with the preferred embodiment of this invention.

Referring to FIGS. 13 and 14 of the drawings, four joints (only one is shown) attach the frame 50 to the wall. The joint 73 has a housing 731 having a first wall defining a slot 732 and a second wall defining a slot 733. Threaded ends of two bolts 72 are inserted through the slot 732. A plate 721 is moved into the housing 731 through the slot 733. The plate 721 defines two holes through which the threaded ends of the bolts 72 are inserted. The threaded ends of the bolts 72 are secured in two threaded nuts 722. Thus, the joint 73 is attached to the wall.

A plate 734 defines two holes through which two threaded bolts 735 is inserted. The plate 734 is linked to the heads of the bolts 735 by means of welding. The plate 734 is moved into the housing 731 through the slot 733. The threaded bolts 735 are disposed outside the housing 731. The threaded bolts 735 are inserted through the slots formed in one of the mounts 62. The threaded bolts 735 are secured in two threaded nuts (not shown) so that the frame 50 is attached to the wall.

It is desired that the columns 63 always align with the tubes 71 through which the bolts 72 are inserted. Thus, the threaded ended of the bolts 72 can be inserted through a corresponding number of the holes formed through the columns 63 and further engaged in a corresponding number of threaded nuts. As a result, the frame 50 can be attached to the wall without the joints 73. This requires that the tubes 71 are buried in the concrete in positive positions. However, it is difficult to retain the tubes 71 in positive positions. That is, there are always misalignment between the columns 63 and the bolts 72. The joints 73 are slidable relative to the bolts 72 as the bolts 72 are slidable in the slots 732. As the bolts 735 are slidable in the slot 733 and further as they are inserted through a corresponding number of holes formed through the columns 63, the columns 63 are slidable relative to the joints 73. Therefore, the misalignment between the columns 63 and the bolts 72 can be compensated for by means of the joints 73.

Figure 15:
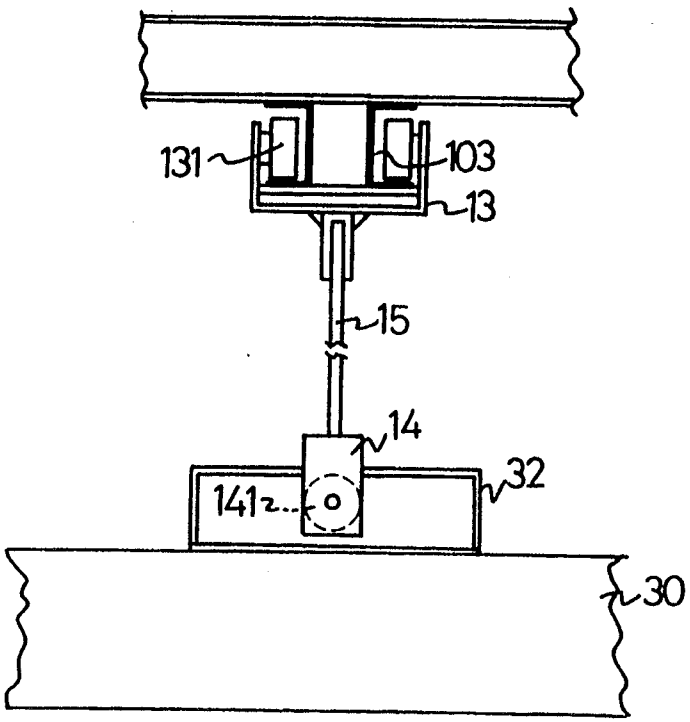
FIG. 15 is a left view of a first rail-and-trolley assembly for conveying shutters for concrete in accordance with the preferred embodiment of this invention.

Referring to FIGS. 1 and 15 of the drawings, two of the rails 103 horizontally extend parallel to each other. Each of the rails 103 is like a "U" rotated 90°, i.e., it has a vertical body formed between an upper flange and a lower flange. The lower flanges of the rails 103 face away from each other.

A trolley 13 has a frame having two cheeks on which two casters 131 are rotatably mounted. The trolley 13 is slidably engaged with the rails 103, with the casters 131 rolling on the lower flanges of the rails 103.

The frame of the trolley 13 is linked to a frame of a trolley 14 by means of a link 15. The frame of the trolley 14 has two cheeks on which two casters 141 are mounted.

A rail 32 has a vertical body formed between an upper flange and a lower flange. The upper flange of the rail 32 is slidable on the casters 141. The lower flange of the rail 32 is attached to one shutter 30.

Accordingly, the shutter 30 can be carried by means of the carrier. The shutter 30 is longitudinally slidable relative to the rails 103 by means of the trolley 13 engaged with the rails 103. The shutter 30 is transversely slidable relative to the rails 103 by means of the trolley 14 engaged with the rail 32.

Figure 16:
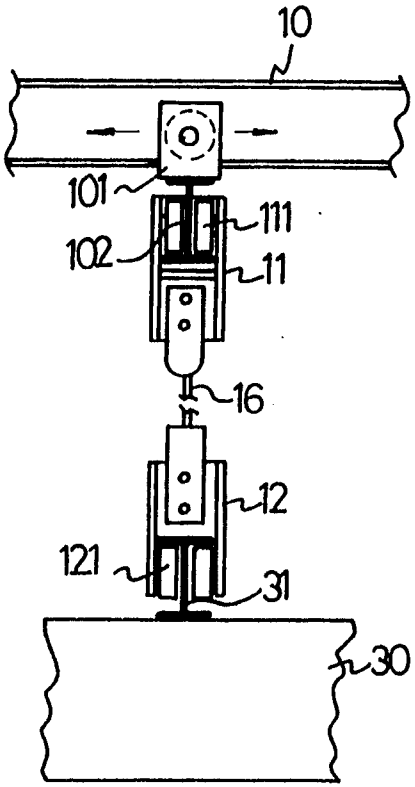
FIG. 16 is a left view of a second rail-and-trolley assembly for conveying shutters for concrete in accordance with the preferred embodiment of this invention.

Referring to FIG. 16 of the drawings, a rail 10 is transversely mounted on the rails 103. The rail 10 has a vertical body formed between an upper flange and a lower flange. A trolley 101 has a frame having two cheeks on which two casters are rotatably mounted. The trolley 101 is slidably engaged with the rail 10, with the casters rolling on the lower flange of the rail 10.

A rail 102 has a vertical body formed between an upper flange and a lower flange. The upper flange of the rail 102 is attached to the frame of the trolley 101 so that the rail 102 is slidable relative to the rail 10.

A trolley 11 has a frame having two cheeks on which two casters 111 are rotatably mounted. The trolley 11 is slidably engaged with the rail 102, with the casters 111 rolling on the bottom flange of the rail 102.

The frame of the trolley 11 is linked to a frame of a trolley 12 by means of a link 16. The frame of the trolley 12 has two cheeks on which two casters 121 are mounted.

A rail 31 has a vertical body formed between an upper flange and a lower flange. The upper flange of the rail 31 is slidable on the casters 121. The lower flange of the rail 31 is attached to one shutter 30.

The shutter 30 is longitudinally slidable relative to the rail 10 by means of the trolley 101 engaged with the rail 10. The shutter 30 is transversely slidable relative to the rail 10 by means of the trolley engaged with the rail 102. The shutter 30 is further transversely slidable with respect to the rail 10 by means of the trolley 12 engaged with the rail 31.

By means of the rail-and-trolley assembly as shown in FIG. 15, the shutter 30 is transversely slidable relative to the rails 103 for a limited distance as the rail 32 has a limited width. By means of the rail-and-trolley assembly as shown in FIG. 16, the shutter 30 is transversely slidable relative to the rail 103 for any appropriate distance as the rail 10 has an appropriate length.

Accordingly, workers, tools, materials and etc. can be moved in various points in various levels by means of the carrier. The carrier replaces conventional scaffolds.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A carrier comprising:

a frame comprising a middle portion transversely formed between two lateral portions attachable to and detachable from a layer of wall formed between two shutters, the lateral portions having a length more than twice as great as the height of the shutters;

a rectilinear elevator having a ladder slidably inserted through a tubular climber attached to the middle portion of the frame so that the frame is slidable upwards and downwards by means of the elevator, the operator moving itself upwards relative to the frame when the lateral portions of the frame are attached to a first layer of wall so that the frame carries workers who install shutters between which concrete is grouted for a second layer of wall, the elevator moving the frame upwards relative thereto when the second layer of wall solidifies so that the lateral portions of the frame can be detached from the first layer of wall and attached to the second layer of wall and that the elevator can move itself upwards relative to the frame, thus, it being possible to grout concrete between shutters for higher layers of wall by repeating the above-defined steps.

2. A carrier in accordance with claim 1, wherein the elevator comprises two rods attached to the ladder.

3. A carrier in accordance with claim 2, wherein the frame comprises two pairs of rollers rotably mounted thereon, and the two rods of the elevator are inserted between the pairs of rollers.

4. A carrier in accordance with claim 1, wherein the middle portion of the frame comprises two rails for engaging with a first trolley for carrying the shutters.

5. A carrier in accordance with claim 4, further comprising a link for linking the first trolley to a second trolley for engaging with a rail attached to the shutters.

6. A carrier in accordance with claim 5, further comprising a rail, transversely mounted on the middle portion of the frame, for engaging a third trolley for carrying the shutters.

7. A carrier in accordance with claim 6, further comprising a link for linking the third trolley to a fourth trolley for engaging with a rail attached to the shutters.

* * * * *